US011414906B1

(12) United States Patent
Tallent

(10) Patent No.: US 11,414,906 B1
(45) Date of Patent: Aug. 16, 2022

(54) DEVICE AND METHOD FOR PROPPING A COMMERCIAL DOOR OPEN

(71) Applicant: Jeff Tallent, Morrow, GA (US)

(72) Inventor: Jeff Tallent, Morrow, GA (US)

( * ) Notice: Subject to any disclaimer, the term of this patent is extended or adjusted under 35 U.S.C. 154(b) by 0 days.

(21) Appl. No.: 17/332,611

(22) Filed: May 27, 2021

(51) Int. Cl.
*E05F 5/02* (2006.01)
*E05C 17/00* (2006.01)
*E05D 11/10* (2006.01)

(52) U.S. Cl.
CPC ..... *E05C 17/025* (2013.01); *E05D 11/1007* (2013.01); *E05Y 2900/132* (2013.01)

(58) Field of Classification Search
CPC ..... Y10T 16/61; Y10T 16/551; E05D 11/06; E05D 11/10; E05D 11/1007; E05D 11/1028; E05D 11/1014; E05D 11/0054; E05D 2011/10; E05D 2011/1028; E05D 2011/1092; E05Y 2201/218; E05Y 2201/224; E05Y 2900/132; E05F 5/06; E05C 17/00; E05C 17/025
See application file for complete search history.

(56) References Cited

U.S. PATENT DOCUMENTS 5,511,837 A * 4/1996 Dempsey ..... E05C 17/025 292/288
6,135,516 A * 10/2000 Gasperino ..... B62B 3/1428 280/47.27
7,559,114 B2 * 7/2009 Ranilovich ..... E05D 11/00 292/288
7,904,992 B2 3/2011 Agster et al.
8,458,958 B2 6/2013 Cress
8,678,453 B2 3/2014 Caliguri et al.
8,727,404 B2 * 5/2014 Martin ..... E05B 17/005 292/341.14
8,863,561 B2 * 10/2014 Orlov ..... E05C 17/54 292/343
8,955,891 B2 2/2015 Millsap
9,127,489 B2 * 9/2015 Orlov ..... E05C 17/54
9,587,419 B1 * 3/2017 Turner ..... E05D 3/02
9,670,706 B2 * 6/2017 Ching ..... E05C 19/184
10,801,238 B1 * 10/2020 Cox ..... E05C 17/025
11,319,008 B2 * 5/2022 Pascoe ..... B62D 65/026
2005/0050681 A1 * 3/2005 Schlitter ..... E05F 5/06 16/82

(Continued)

FOREIGN PATENT DOCUMENTS

FR 2677398 A3 * 12/1992 ..... E05C 17/025

*Primary Examiner* — Chuck Y Mah
(74) *Attorney, Agent, or Firm* — J.T. Hollin, Attorney at Law, P.C.

(57) ABSTRACT

Disclosed is a door holder which comprises a planar, rectangular plate the plate constructed with two integral channels, oriented parallel to the left and right edges, respectively, of the rectangular plate. The door holder serves as a means to prop open a heavyweight, commercial door, the subject door being operated by spring-loaded hinges. The door may be continuously held open by means of bracing either edge of the rectangular plate against the outer edge of a doorstop. In conjunction with the placement of an edge of the door holder against the doorstop, one of the integral channels is then mounted so as to straddle the top of the shoulder of the leaf of one spring-loaded hinge. In this manner, the door is forcibly held in an open position, forming a ninety-degree angle between the plane of the door frame and the face of the door.

12 Claims, 5 Drawing Sheets

(56) References Cited

U.S. PATENT DOCUMENTS

Figure 1:
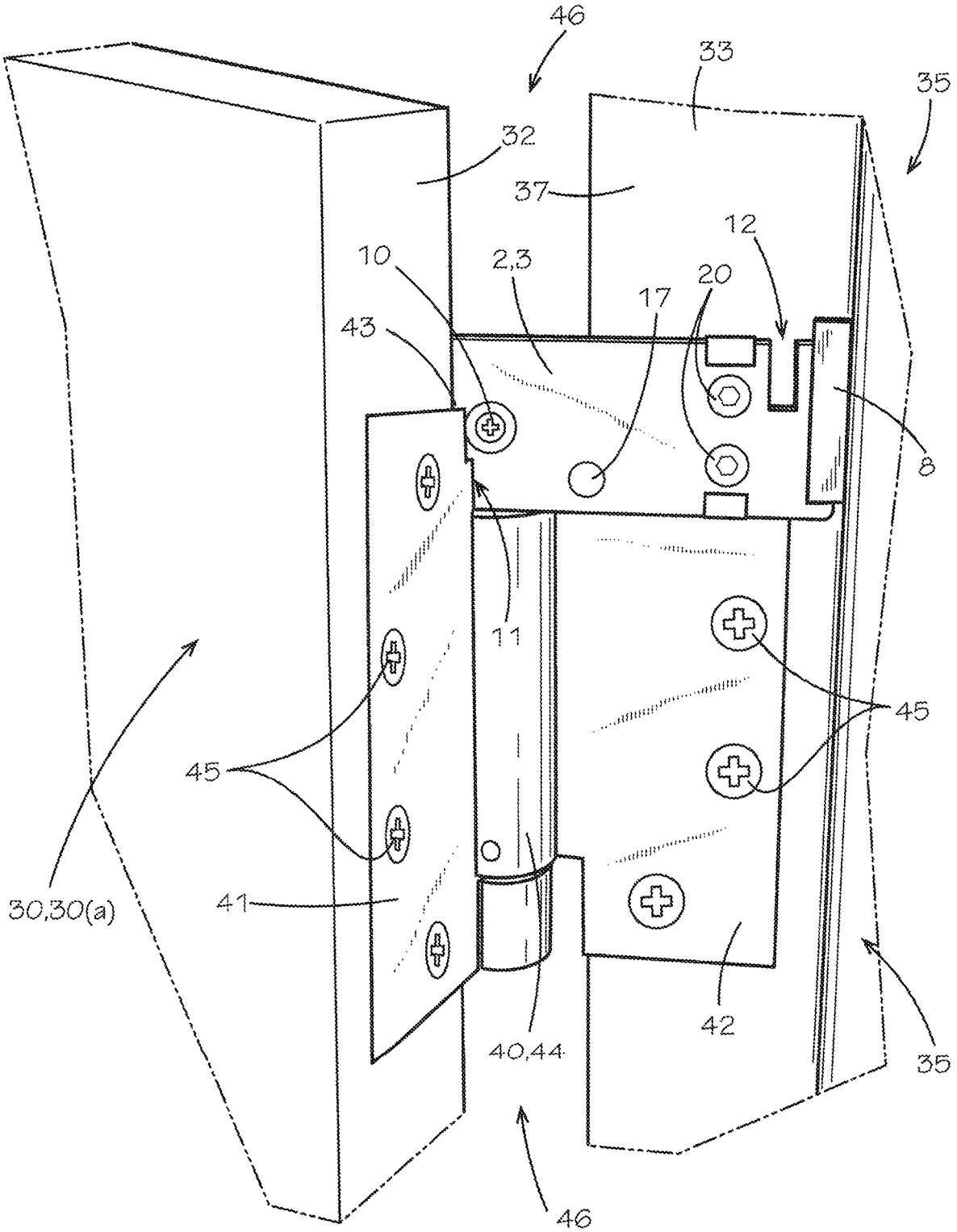

| | | | | |
|---|---|---|---|---|
| 2014/0225385 | A1* | 8/2014 | Millsap | E05C 17/025<br>292/288 |
| 2018/0128025 | A1* | 5/2018 | Estrada | E05C 17/56 |
| 2019/0226250 | A1* | 7/2019 | Pavlow | E05C 17/54 |
| 2020/0181962 | A1* | 6/2020 | Mikesell | E05D 11/1014 |
| 2020/0208447 | A1* | 7/2020 | Farkas | E05C 17/54 |

* cited by examiner

DEVICE AND METHOD FOR PROPPING A COMMERCIAL DOOR OPEN

CROSS-REFERENCES TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

BACKGROUND OF THE INVENTION

(1) Field of the Invention

The field of the present inventive concept relates generally to methods and devices utilized for maintaining a heavy commercial door in the open position. Hundreds of thousands of hotels, office buildings, schools and other edifices providing access to consumer traffic are equipped with automatic, spring-loaded entry/exit doors. Most doors of this type are 1 & ¾ inch thick, and also serve security and fire suppression functions when they are closed. However, there are some occasions when it is beneficial or critical to prop such doors open temporarily. Hotel employees, janitorial staff, and in critical circumstances, fire fighters have a need to hold a door open, preferably as wide as possible to perform their duties.

In those instances, it is practical and convenient to use some type of door prop device to maintain the door, or side-by-side double doors, in an open position for the brief periods of time necessary. Bellmen, in the course of their customer service functions, must enter various guest rooms many times a day pushing baggage carts or carrying bags for guests. Their services are easily and professionally performed when the door to the room being accessed can be held open by a door prop device.

The present inventive concept addresses the need for a small, yet strong device for holding these heavyweight doors in the open position. Further, the disclosed door holder device also functions to prop open commercial doors constructed with a continuous vertical hinge running the entire length of the door stile. The door holder device is constructed so as to be easily and conveniently carried on the person of the user. Two integral magnets also enable storage of the door holder device on the surface of a metallic door.

(2) Description of the Related Art, Including Information Disclosed Under 37 CFR 1.97 and 1.98.

U.S. Pat. No. 8,955,891; Millsap; Feb. 17, 2015. There is a door stop including a block having a top surface and a bottom surface. The block includes an engaging perimeter and a non-engaging perimeter opposite the engaging perimeter and is disposed between the top surface and the bottom surface. The block includes a protrusion extending therefrom at a boundary region between the engaging perimeter and the non-engaging perimeter. The door stop includes a plurality of magnets disposed in an array along an exterior of the engaging perimeter. The door stop includes a recessed portion disposed about the engaging perimeter and is configured to rest about a hinge of a door.

U.S. Pat. No. 8,727,404; Martin; May 20, 2014. A device for preventing a door with an automatic locking mechanism from locking and for propping a door in an open position is provided. The device includes a bar with a first surface and an opposing second surface. One or more magnets are connected to the first surface by glue. A foam layer is also connected to the first surface.

U.S. Pat. No. 8,678,453; Caliguri, et al. Mar. 25, 2014. A portable door propping apparatus includes a first arm, a second arm, and a coupling member. The first arm is pivotally coupled with the second arm. The portable door propping apparatus can be hung on a door hinge, to facilitate propping of the door in an opened position. Methods are also provided.

U.S. Pat. No. 8,458,958; Cress; Jun. 11, 2013. A doorprop for restricting the movement of a door within a doorway. The door includes a first door face surface and a first door side surface. The doorway includes a hinge jamb having a door edge abutting surface, a door side abutting surface, a jamb trim surface, and a hinge jamb edge. The stop includes a contoured body defined by an upper surface, a lower surface, a door face surface, a door contacting surface, a first door transition surface, a jamb face surface, a jamb trim edge surface, a jamb trim face surface, and a second transition surface. The door contacting surface is selectively in contact with the first door side surface.

U.S. Pat. No. 7,904,992; Agster, et al; Mar. 15, 2011; A door stop device comprising a block member, a receiving channel to facilitate placement of the device onto a door hinge, and an attaching means suitable for removably attaching the door stop device to an item of clothing worn by a user. The door prop device of the present invention is designed to be readily accessible and available for immediate use by those who primarily work in, or provide service to, the resort, hotel and motel industries.

BRIEF SUMMARY OF THE INVENTION

The disclosed device, referred to as a door holder 1, comprises essentially a metallic, planar plate 2, the plate 2 constructed with two integral, rectangular, open channels 11, 12. The door holder 1 device serves as a means to prop open a heavyweight, commercial door 30, the subject door 30 normally of metallic construction and operated by a plurality of spring-loaded hinges 40. A continuously open orientation of the door 30 is accomplished with the first step being bracing either the left edge 22, or right edge 24, of the door holder 1 against the outer edge of a doorstop 35.

In conjunction with the positioning of either edge 22, 24 of the door holder 1, one of the parallel channels 11, 12 is next mounted so as to straddle the top of the shoulder 43 of either the left leaf 41 or right leaf 42 of the spring-loaded hinge 40. The left leaf 41 and right leaf 42 of the spring-loaded hinge 40 are fastened to the hinge door stile 31 and the door stop 35 of the subject door 30 and door frame, respectively.

In this manner, the door 30 is forcibly held in an open position. In the preferred embodiment, the open position forms a ninety-degree angle between the plane of the door frame and the inner face 30(*a*) of the door 30.

The door holder 1 may also be utilized to prop open the type of commercial door having a continuous vertical, spring-loaded hinge component which vertical hinge runs the entire length of the door stile 31. The door holder 1 device is also designed to be easily and conveniently carried on the person of a user, by means of an auxiliary aperture 17 which can accommodate a wire or cord-type structure attached to a corresponding door key. Two integral magnets 5, 6 also enable magnetized stowage of the door holder 1 device onto a surface of a metallic door 30, or its associated door frame when not in use.

BRIEF DESCRIPTION OF THE VIEWS OF DRAWINGS AS EXEMPLARY EMBODIMENTS OF THE INVENTIVE CONCEPT

FIG. 1 is a view looking inwardly toward the top segment of a door 30, being held fully open by the door holder 1. Shown in FIG. 1 is the principal component of the door holder 1, the plate 2, having been inserted with its left channel 11 (out of view) mounted atop the shoulder 43 of the left leaf 41 of an attached spring-loaded door hinge 40.

Figure 2:
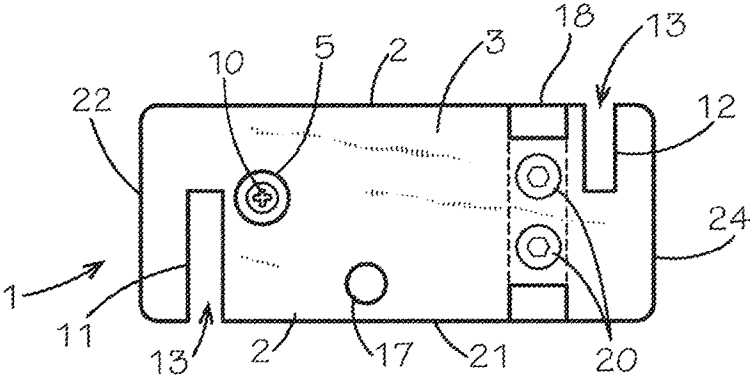

FIG. 2 displays a full direct view of the front surface 3 of the plate 2. Other principal components shown are an integral left channel 11, a front magnet 5, an aperture 17, and two 8/32 inch button-head screws 20 which continue through to the rear surface 4 of the plate 2 for retaining a brace 18, and an integral right channel 11 with its opening 13.

Figure 3:
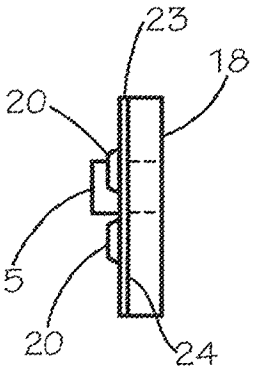

FIG. 3 is a right-side view of the door holder 1 of FIG. 2, further showing the right edge 24, the two button-head screws 20 which retain the brace, 18, and a partial view of the front magnet 5.

Figure 4:
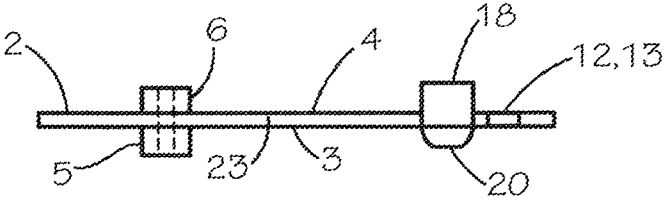

FIG. 4 illustrates the door holder 1 viewed from its upper edge 23, further showing the front magnet 5, rear magnet 6, the brace 18, a button-head screw, and the opening 13 to the right channel 12.

Figure 5:
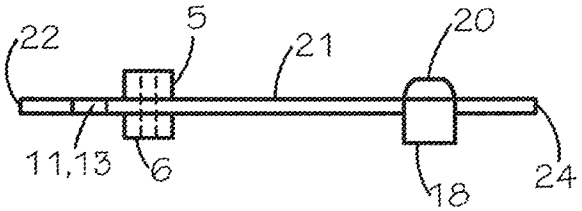

FIG. 5 is a view from the perspective of looking upward at the lower edge 21 of the door holder 1 of FIG. 2, further showing the opening 13 of the left channel 11, the front magnet 5, rear magnet 6, brace 18, and the bottommost button-head screw 20.

Figure 6:
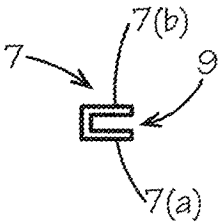

FIG. 6 is a profile view, looking longitudinally at the cross-sectional contour of the left sleeve 7. When in use, the left sleeve 7 is placed so as to fit snugly onto the plate 2 left edge 22.

Figure 7:
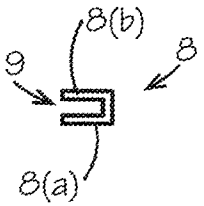

FIG. 7 is a profile view of the contour of the right sleeve 8, oriented so as to demonstrate its pending placement onto the plate 2 right edge 24.

Figure 8:
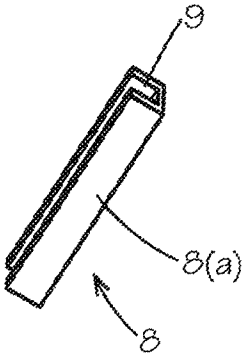

FIG. 8 is a perspective view of the right sleeve 8. The left sleeve 7 is an exact replica of the right sleeve 8. Both sleeves, 7,8 manifest a U-shaped hollow 9, the hollow 9 having dimensions enabling a tight fit onto either the right edge 24 or left edge 22 of the plate 2.

Figure 9:
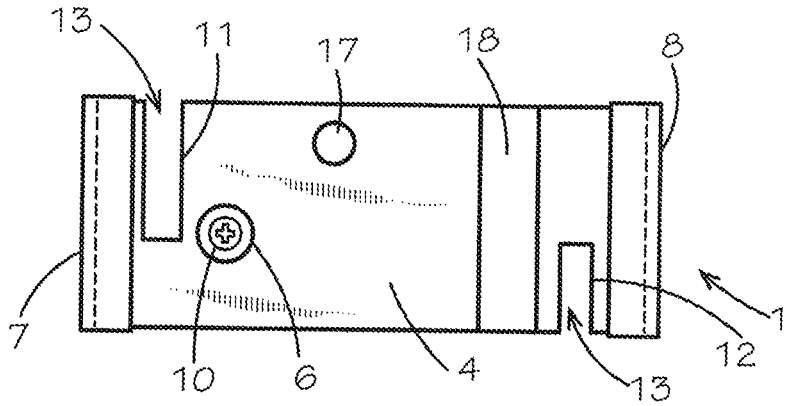

FIG. 9 is a view of the rear surface 4 of the plate 2 of the door holder 1, the plate 2 having been placed in an inverted orientation from FIG. 2. Further shown is the attached left sleeve 7, the left channel 11 and its opening 13, a flat-head screw 10 (serving to attach a rear magnet 6), the aperture 17, brace 18, the right channel 12, and attached right sleeve 8.

Figure 10:
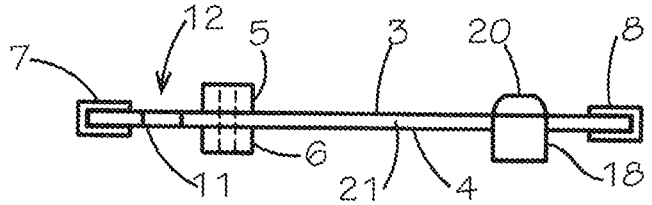

FIG. 10 is a view oriented looking downward at the door holder 1 shown in FIG. 9. The primary components shown are the plate lower edge 21, the attached left sleeve 7, the left channel 11, front magnet 5, rear magnet 6, the aperture 17, the brace 18, and the attached right sleeve 8.

Figure 11:
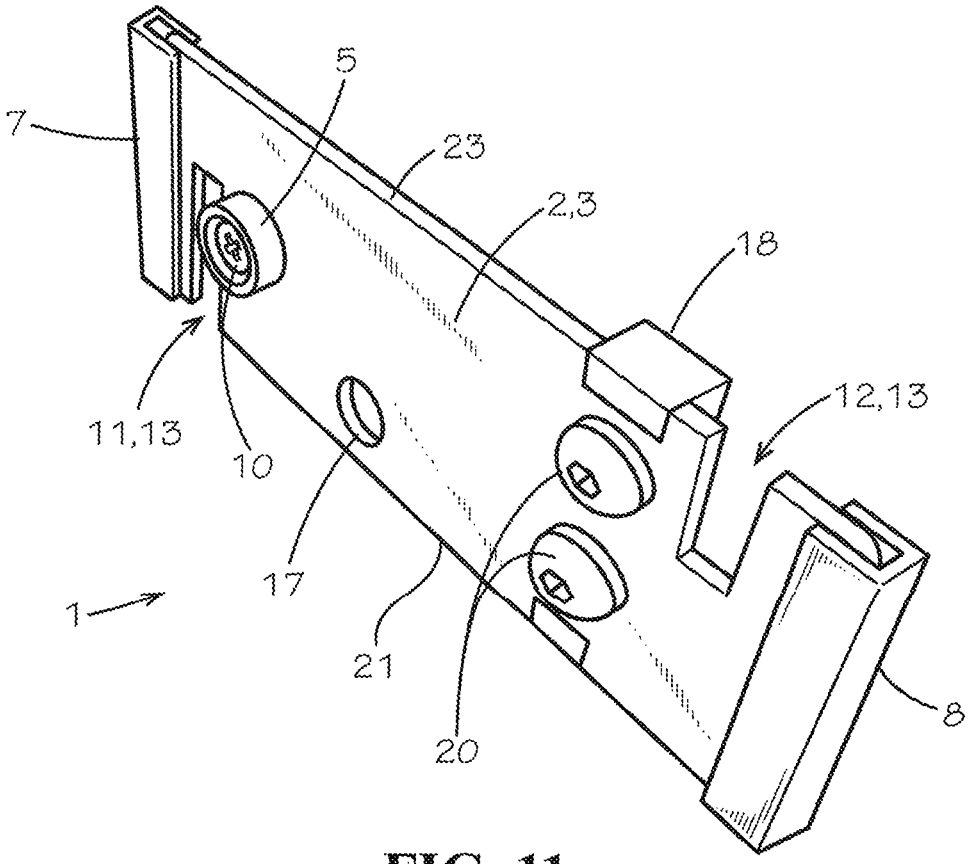

FIG. 11 is a three-dimensional rendering of the door holder 1, showing the plate front surface 3, the attached left sleeve 7, the front magnet 5, the upper edge 23, the left channel 11, the aperture 17, the two button-head screws 20, the right channel 12 and its opening 13, and the attached right sleeve 8.

Figure 12:
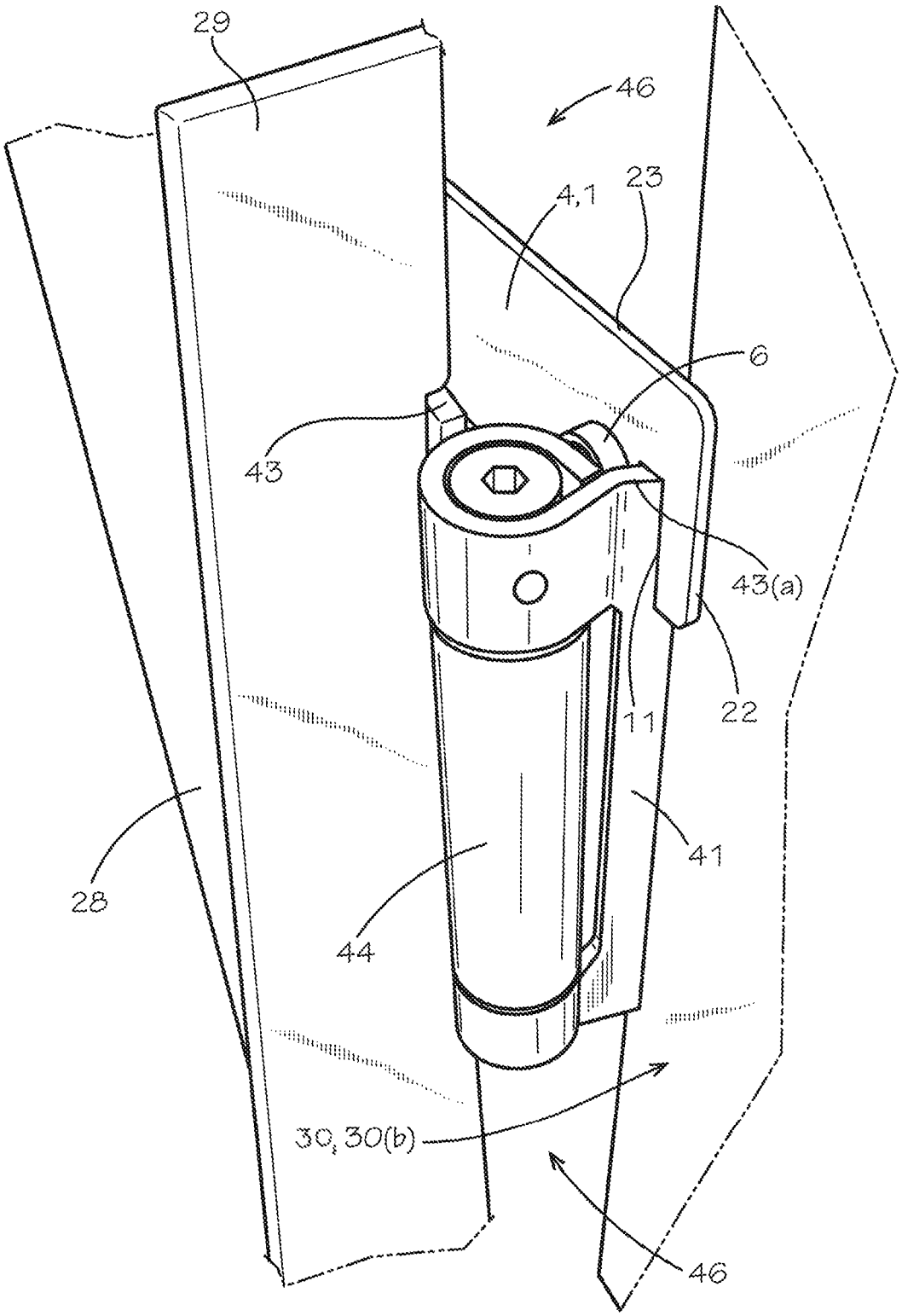

FIG. 12 is a view from a perspective exteriorly to a doorway, the view prominently showing a gap 46 created by the opening of a door outer face 30(*b*), the door 30 being held in the open position by the plate 2 of a door holder 1.

Figure 13:
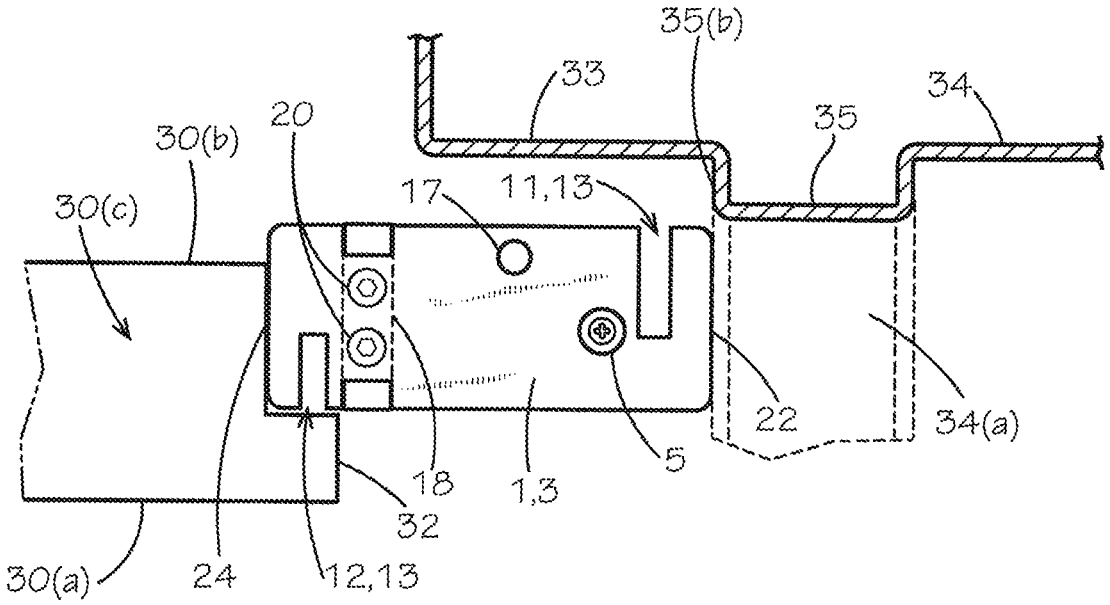

FIG. 13 presents a condition in which the door holder 1 is utilized in a horizontal orientation to maintain a door inner face 30(*a*) in an open position, ninety degrees from the door's normal closed position. The condition shown displays use of the door holder 1 in the instance of a door 30 which is hung on a continuous vertical hinge.

Figure 14:
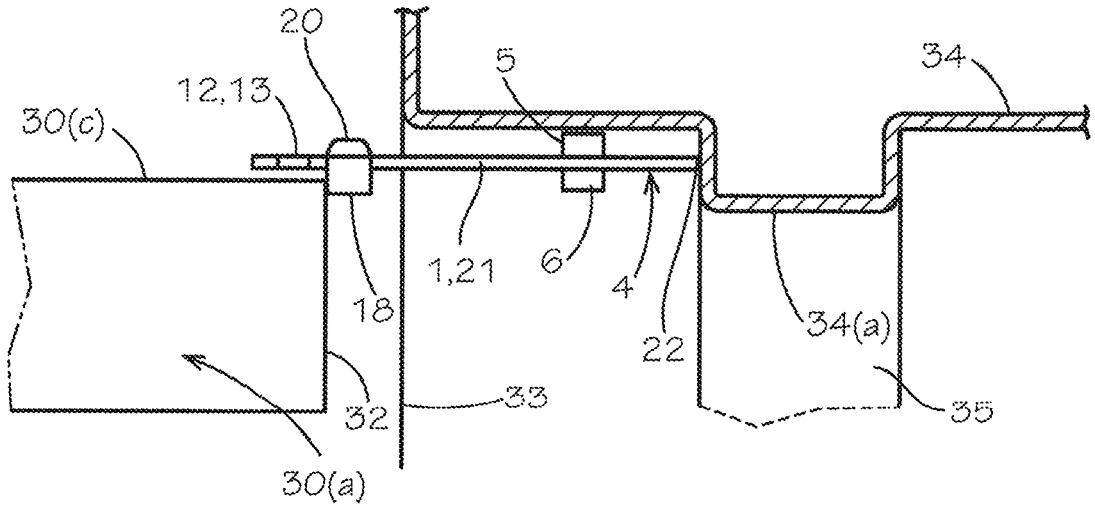

FIG. 14 depicts a view looking parallel to the plane of the door holder 1 shown in FIG. 13. As stated earlier, the door holder 1 is oriented perpendicular to a subject door frame. The condition shown in FIG. 14 displays use of the door holder 1 in the instance of a door 30 which is hung on a continuous vertical hinge.

TABLE OF NOMENCLATURE & PART NUMBERS OF INVENTION

1. Door holder
2. Plate
3. Plate front surface
4. Plate rear surface
5. Front magnet
6. Rear magnet
7. Left sleeve
7(*a*) Inner surface
7(*b*) Outer surface
8. Right sleeve
8(*a*) Inner surface
8(*b*) Outer surface
9. Hollow
10. Flat-head screw
11. Left channel
12. Right channel
13. Opening
14.-16. n/a
17. Aperture
18. Brace
19. n/a
20. Button-head screw
21. Plate lower edge
22. Plate left edge
23. Plate upper edge
24. Plate right edge
25.-27. n/a
28. Wall
29. Doorframe
30. Door
30(*a*) Door inner face
30(*b*) Door outer face
30(*c*) Door top
31. Hinge stile
32. Rear of door stile
33. Outer jamb
34. Inner jamb
34(*a*) Head jamb
35. Doorstop
35(*a*) Inner stop
35(*b*) Outer stop
36. n/a
37. Rabbet
38.-39. n/a
40. Spring-loaded hinge
41. Left leaf
42. Right leaf
43. Shoulder
44. Knuckle
45. n/a
46. Gap

DETAILED DESCRIPTION OF THE INVENTION

The objects, features, and advantages of the inventive concept presented in this application are more readily understood when referring to the accompanying drawings. The drawings, totaling fourteen figures, show the basic components and functions of embodiments and/or methods of use. In the several figures, like reference numbers are used in each figure to correspond to the same component as may be depicted in other figures.

The discussion of the present inventive concept will be initiated with FIG. 1, in order to give an overall preview of the manner of utilization of the door holder 1. FIG. 1 depicts a view looking, from the interior of a room, toward a commercial door 30 equipped with a spring-loaded door hinge 40. All references using the term "door hinge 40" in this disclosure will refer to a spring-loaded door hinge. The door 30 is being held fully open by the plate 2 of the door holder 1, exposing a resulting open space, or gap 46 between the rear of the door stile 32 and the door rabbet 37. The left edge 22 (not in view) of the plate 2 of the door holder 1 has been inserted so as to mount the left channel 11 atop the shoulder 43 (out of view) of the left leaf 41 of the door hinge 40.

In FIG. 1, the right sleeve 8 of the door holder 1, which envelops the right edge 24 (not in view) of the plate 2, is braced against the door stop 35, thereby restricting inward movement of the hinge 40. The left leaf 41 and right leaf 42 of the door hinge 40 function in conjunction with the rotating knuckle 44 of the hinge 40 structure. This configuration provides a rigid, immovable obstacle to closure of the door 30.

The right sleeve 8 serves to cover the right edge 24 (out of view) of the plate 2, thereby preventing scraping or grazing of the surface of the door 30 or door stop 35. In a similar manner, the left sleeve 9 functions to cover the left edge 22 of the plate 2, also preventing scraping or grazing of doors and frames.

In viewing FIG. 2, a full, frontal view of the door holder 1 is presented, showing the device essentially to be a metal plate 2, having a plate front 3, a plate upper edge 23, a plate right edge 24, a plate lower edge 21, and a plate left edge 22. In the preferred embodiment, the door holder 1 plate 2 is fabricated from 1095 spring steel.

In FIG. 2, the principal components of the door holder 1 are shown to be an integral left channel 11 having two parallel sides, and its opening 13, a front magnet 5, which is held in place by a button-head screw 48, an aperture 17, two button-head screws 20 which pass through the plate 2 to retain a solid brace 18 (hidden from view) on the rear surface 4 of the plate 2, and lastly, an integral right channel 12 having two parallel sides with an opening 13. The left channel 11 and the right channel 12 of the plate 2 are utilized to mount atop the shoulder 43, of either the left leaf 41 or right leaf 42 of the typical spring-loaded hinge 40. Each shoulder 43 typically is constructed as a co-planar extension of each leaf 41, 42 integral to spring-loaded hinges 40.

FIG. 3 is a right-side view of the door holder 1 shown in FIG. 2, further showing the right edge 24, the top and bottom button-head screws 20, which retain the brace 18, and a partial view of the front magnet 5. In circumstances where the subject door 30 is hung by means of a continuous vertical hinge, the door 30 may be maintained in an open position by orienting the door holder 1 horizontally and placing the brace 18 in abutment to the very top of the inner face 30(*a*) of the door 30, while the right edge 22 is propped against the outer surface of the overhead jamb 34(*a*). This orientation is more clearly shown in FIG. 13 and FIG. 14.

FIG. 4 illustrates the top view of the door holder 1 of FIG. 2, further showing the upper edge 23, the front magnet 5, and a rear magnet 6. Both the front magnet 5 and the rear magnet 6 are internally threaded and are mutually held in place, abutting the front surface 3 of the plate 2 and the rear surface 4 of the plate 2, respectively. The front magnet 5 and rear magnet 6 are retained by means of the flathead screw 10 (not in view). Also visible in FIG. 4 is the upper button-head screw 20, which retains the upper segment of the brace 18, and the right channel 12 with its opening 13.

FIG. 5 is a view oriented looking upward directly at the door holder 1 of FIG. 2, further showing the plate 2 lower edge 21, the opening 13 of the left channel 11, both the front magnet 5, and rear magnet 6, each being held in place, abutting the front surface 3 of the plate 2 and the rear surface 4 of the plate 2, respectively, by means of the flathead screw 10. Further shown is the lower button-head screw 20, which retains the lower segment of the brace 18.

FIG. 6 is a profile view of the contour of the removable left sleeve 7, which, when used, is placed onto the plate 2 left edge 22. The left sleeve 7 is constructed from slippery plastic trim, and serves to protect doors and door frames from scratching or marring. The left sleeve is constructed with a U-shaped transverse cross-section, thereby comprising a hollow 9, the hollow 9 formed with internal dimensions which correspond exactly to the thickness of the plate left edge 2.

FIG. 7 is a profile view of the contour of the removable right sleeve 8, also constructed from slippery plastic trim. The right sleeve 8, when used, is placed onto the plate right edge 24. The right sleeve 8, identical to the left sleeve 7, is formed with a U-shaped transverse cross-section, thereby comprising a hollow 9, the hollow 9 having internal dimensions which correspond exactly to the thickness of the plate 2 right edge 24.

FIG. 8 presents a perspective view of the contour and general construction of the right sleeve 8. It should be noted that FIG. 8 also represents the exact replica of the contour and construction of the left sleeve 7 as well. The right sleeve 8 and the left sleeve 7 both manifest a U-shaped hollow 9, the hollow 9 having dimensions enabling a precise fit onto either the right edge 24 or left edge 22 of the plate 2.

FIG. 9 is a view depicting a "flipping" of the door holder 1 as previously shown in FIG. 2. FIG. 9 therefore shows the rear surface 4 of the plate 2 of the door holder 1, resulting from the re-orienting the door holder 1 to an inverted position. Shown from left to right in FIG. 9, is the attached left sleeve 7, the left channel 11 and its opening 13, the rear magnet 6 being retained against the rear surface 4 of the plate 2 by means of a flat-head screw 10, the aperture 17, brace 18, the right channel 12 and its opening 13, and the attached right sleeve 8.

FIG. 10 illustrates a view from the perspective of looking downward onto the door holder 1 shown in FIG. 9. The main features shown are the plate lower edge 21, the attached left sleeve 7, the left channel 11, the front magnet 5, rear magnet 6, the aperture 17, the brace 18, as held in place by a button-head screw 20, and the attached right sleeve 8.

FIG. 11 is a three-dimensional, enlarged rendering of the door holder 1, showing the plate 2 front surface 3, the attached left sleeve 7, the upper edge 23, and the left channel 11 including its opening 13. The front magnet 5 is shown as being retained in position by the hexagonal head bolt 10. Further shown are the aperture 17, the button-head screws 20 which jointly attach the brace 18 to the rear surface 4 (not in view) of the plate 2, the right channel 12, along with its opening 13, and the attached right sleeve 8.

In the preferred embodiment of the door holder 1, for utilization of the door holder 1 with most commercial doors, there is a general range of approximate dimensions of the structural components of the door holder 1 as follows:

Plate 2 length, e.g., the upper edge and lower edge, each 3.25 inches

Plate 2 width, left and right edge, each 1.25 inches;

Plate 2 thickness 1/32 inch;

Left channel, 11 0.75 inch length by 0.25 inch width of opening;

distance of outermost side of left channel 11 from the plate left edge, 0.75 inch; Right channel, 12 0.50 inch length, by 3/16 inch width opening;

distance of right channel 12 from the plate right edge, 0.75 inch; and Brace, 3/16 inch by 3/32 inch lateral cross-section, by 1.25 inch in length.

FIG. 12 is a view from the perspective of a user standing outside a doorway in which the outer face 30(*b*) of an attached door 30 is in held in a substantially open position, showing a noticeable gap 46 formed by the opening of the door 30. Directly in the user's line-of-sight is the knuckle 44 mechanism of a spring-loaded hinge 40. Further shown is a limited view of the shoulder 43 of the right leaf 42 (hidden from view). The outer surface of the left shoulder 43(*a*) and left leaf 41 of the spring-loaded hinge 40 are also shown. In FIG. 12, the right leaf 42 (hidden from view) is attached to the door frame 29, the exterior wall 28 of the room also being shown. The partially visible left leaf 41 is attached to the door stile 32 (not in view) of the door 30.

In evaluating FIG. 12 in more detail, it is seen that the rear surface 4 of the door holder 1 plate 2 is oriented outwardly toward the induced gap 46. The left edge 22 of the door holder 1 is extended slightly past the created gap 46, and is located in close proximity to the outer face 30(*b*) of the door 30. This proximity results from the left channel 11 of the door holder 1 being engaged with the shoulder 43(*a*) of the left leaf 41 of the spring-loaded hinge 40.

In FIG. 12, the door 30 as seen, is being held fully open by the door holder 1. Additionally shown is the plate rear surface 4, the door holder 1 having been inserted with its left channel 11 mounted, or saddled, atop the shoulder 43 of the left leaf 41 of the door hinge 40. The left edge 22 of the plate 2 is shown with the absence of a left sleeve 7, which may be optionally utilized to prevent marring or scratching of the door 30.

FIG. 13 presents a view looking downward toward the door top 30(*c*) of an opened hinged door 30, the door inner face 30(*a*) and outer face 30(*b*) being shown, along with the rear stile 32 of the door 30. The door holder 1 is shown oriented horizontally in a position braced against the rear stile 32 and the overhead doorjamb 34 by means of the brace 18 (out of view). This renders the entirety of the front surface 3 of the door holder 1 plate 2 visible. This placement of the door holder 1 is utilized when propping open commercial doors having a continuous spring-loaded hinge mechanism which runs the entire length of a doorway and door stile.

It is to be noted, in FIG. 13, the brace 18 (shown by broken lines) of the door holder 1 is abutting the very top of the rear of the door stile 32 of the door 30, while simultaneously, the left edge 22 of the door holder plate 2 is in direct abutment with the overhead doorjamb 34(*a*). Thereby, the door 30 is maintained in a fully open position, approximately ninety degrees from the closed position. For the sake of clarity, neither the left sleeve 7 or right sleeve 8 are depicted in attachment to the door holder 1

FIG. 14 is a view looking parallel to the plane of the door holder 1 depicted in FIG. 13. The view of FIG. 14 is also perpendicular to the inner doorjamb 34 of a subject door frame. FIG. 14 illustrates a side view of the presentation shown in FIG. 13, looking directly at the lower edge 21 of the door stop 1. Additionally in view in FIG. 14 is the door inner face 30(*a*) and the cross-sectional outline of the outer segment 33 of the overhead door jamb 34(*a*) and the inner portion 34 of the overhead door jamb 34(*a*).

As shown in FIG. 14, the brace 18 of the door holder 1 is abutting the very top of the rear of the door stile 32 of the door 30 while simultaneously, the left edge 22 of the door holder plate 2 is in direct abutment with the outer surface of the overhead jamb 34(*a*). In this manner, the door 30 is propped open, spread ninety degrees from its normally closed position.

The door holder 1 of FIG. 14 is shown oriented horizontally in a position which braces against the rear door stile 32 and the overhead doorjamb 34(*a*), thereby maintaining the door 30 in a fully open position, approximately ninety degrees from the closed position.

While preferred embodiments of the present inventive method have been shown and disclosed herein, it will be obvious to those persons skilled in the art that such embodiments are presented by way of example only, and not as a limitation to the scope of the inventive concept. Numerous variations, changes, and substitutions may occur or be suggested to those skilled in the art without departing from the intent, scope, and totality of this inventive concept. Such variations, changes, and substitutions may involve other features which are already known per se and which may be used instead of, in combination with, or in addition to features already disclosed herein. Accordingly, it is intended that this inventive concept be inclusive of such variations, changes, and substitutions, as described by the scope of the claims presented herein.

What is claimed is:

1. A door holder device for the purpose of maintaining a commercial door, which is mounted with spring-loaded hinges, in an open position, being a ninety-degree orientation from the plane of the associated door frame, the device comprising:

a rectangular plate having a front surface, a rear surface, an upper edge, right edge, lower edge, and left edge; (a) at least one integral channel of inner dimensions corresponding to the thickness of a door hinge; (b) a front magnet and a rear magnet, co-axially attached on opposite sides of the rectangular plate; (c) at least one removable sleeve, having an opening with a U-shaped transverse cross-section, the opening equivalent to the thickness of the rectangular plate; and (d) a brace affixed proximate one end of the rectangular plate.

2. The door holder device of claim 1, wherein the rectangular plate is constructed of 1095 spring steel.

3. The door holder device of claim 1, wherein the at least one integral channel comprises a first integral channel and a second integral channel, each channel having sides running parallel to the left and right edges of the rectangular plate.

4. The door holder device of claim 3, wherein:

a) the rectangular plate is 1/16-inch thick 1095 spring steel, and further, the left edge and right edge each measure 1.25 inch, the upper edge and lower edge each measure 3.25 inches;

b) the first channel is constructed of width of 3/16 inch, parallel to, and 1/4 inch from the left edge of the plate, the first channel having an opening originating at the lower edge of the rectangular plate;

c) the second channel is constructed of width of 3/16 inch, parallel to, and 1/4 inch from, the right edge of the plate, the second channel having an opening originating at the upper edge of the rectangular plate;

d) the front magnet is attached to the front surface of the rectangular plate, proximate the first channel, and, the rear magnet is attached to the rear surface of the rectangular plate, proximate the first channel, both the first and second magnet being co-axially secured by means of a common through-bolt;

e) the at least one removable sleeve is clasped about the right edge of the plate, the sleeve having a length of 1.25 inch, and inner dimensions equivalent to the thickness of the plate;

f) an additional removable sleeve, is clasped about the left edge of the plate, the sleeve having a length of 1.25 inch, and inner dimensions equivalent to the thickness of the plate; and (g) the brace consists of a solid, metallic column of ⅜ inch-square cross-section, having a length of 1.25 inch, and permanently affixed proximate the right edge of the rectangular plate, such that the brace protrudes outward from the rear surface of the plate.

5. The door holder device of claim 1, wherein said at least one removable sleeve comprises a left sleeve and a right sleeve, both sleeves having a U-shaped cross section, the inner surface of each sleeve having interior dimensions equivalent to the thickness of the rectangular plate, and further, both sleeves being constructed from slippery plastic trim.

6. The door holder device of claim 1, wherein the plate further comprises an aperture, said aperture for insertion of a keychain, wire, or other cord-like retaining mechanism, the cordlike mechanism enabling carriage of a key fitted to the door lock of the subject door to be retained open.

7. The door holder of claim 1, wherein the at least one removable sleeve is fabricated of slippery plastic trim material.

8. A method for mechanically propping open a commercial door, which door is operated by a plurality of spring-loaded door hinges, where, upon being opened, the door is maintained at an orientation of minimally, ninety-degrees displacement from its normal closed position, the method comprising the steps of:

a) providing a rectangular plate formed from 1095 spring steel, 1/16-inch thick, the plate having a front surface, a rear surface, a left edge, an upper edge, a right edge parallel to the left edge, and a lower edge parallel to the upper edge, the left edge and the right edge measuring 1.25 inch each, the top and bottom edge measuring 3.25 inches each;

b) constructing, within the rectangular plate, a first channel having a width 3/16 inch, parallel to, and ¼ inch from the left edge of the plate, the opening of the first channel originating at the lower edge of the rectangular plate;

c) constructing, within the rectangular plate, a second channel having a width of 3/16 inch, parallel to, and ¼ inch from, the right edge of the plate, the opening of the second channel originating at the upper edge of the rectangular plate;

d) providing a front magnet attached to the front surface of the rectangular plate, proximate the first channel, and, a rear magnet attached to the rear surface of the rectangular plate, proximate the first channel, both the first and second magnet being co-axially secured by means of a common through-screw;

e) providing a brace comprising a solid, metallic column of ⅜ inch-square cross-section, further comprising a length of 1.25 inch, the brace permanently affixed proximate the right edge of the plate; whereby, f) the commercial door is opened to approximately ninety degrees of displacement from its closed position, and, in sequence, (i) the rectangular plate is oriented such that the plane of the rectangular plate is vertical; (ii) the opening of the first channel of the plate is placed above the shoulder of the left leaf of one door hinge; (iii) the first channel is then moved downward so as to saddle the left leaf; (iv) the right edge of the rectangular plate is placed in direct abutment with the interior of the door stop of the doorframe; and (v) upon release of the commercial door, the rectangular plate consequently maintains the door open.

9. The method of claim 8, whereby there is further provided at least one removable sleeve, fabricated from slippery plastic trim material, further having an opening with a U-shaped cross-section, the opening equivalent to the thickness of the rectangular plate, the sleeve having a length equivalent to the right edge of the rectangular plate, and interior dimensions equivalent to the thickness of the rectangular plate.

10. The door holder device of claim 8, wherein the rectangular plate is constructed of 1095 spring steel.

11. The door holder device of claim 8, wherein the plate further comprises an aperture, said aperture for insertion of a keychain, wire, or other cord-like retaining mechanism, the cordlike mechanism enabling carriage of a key fitted to the door lock of the subject door to be retained open.

12. A method for mechanically propping open a commercial door, which door is operated by a continuous, vertically oriented spring-loaded hinge mechanism, where, upon being opened, the door is maintained at an orientation of minimally, ninety-degrees displacement from its normal closed position, the method comprising the steps of:

a) providing a rectangular plate formed from 1095 spring steel, 1/16-inch thick, the plate having a front surface, a rear surface, a left edge, an upper edge, a right edge parallel to the left edge, and a lower edge parallel to the upper edge, the left edge and the right edge measuring 1.25 inch each, the top and bottom edge measuring 3.25 inches each;

b) constructing, within the rectangular plate, a first channel having a width 3/16 inch, parallel to, and ¼ inch from the left edge of the plate, the opening of the first channel originating at the lower edge of the rectangular plate;

c) constructing, within the rectangular plate, a second channel having a width of 3/16 inch, parallel to, and ¼ inch from, the right edge of the plate, the opening of the second channel originating at the upper edge of the rectangular plate;

d) providing a front magnet attached to the front surface of the rectangular plate, proximate the first channel, and, a rear magnet attached to the rear surface of the rectangular plate, proximate the first channel, both the first and second magnet being co-axially secured by means of a common through-screw;

e) providing a brace comprising a solid, metallic column of ⅜ inch-square cross-section, further comprising a length of 1.25 inch, the brace permanently affixed proximate the right edge of the plate; whereby, f) the commercial door is opened to approximately ninety degrees of displacement from its closed position, and, in sequence, (i) the rectangular plate is oriented horizontally with the front surface of the plate facing upward, proximate the top of the door stile; (ii) the brace of the rectangular plate is placed abuttingly against the door stile; (ill) the opposite edge of the rectangular plate is placed abuttingly against the overhead door jamb, and (iv) upon release of the commercial door, the rectangular plate consequently maintains the door open.

* * * * *